United States Patent [19]

Bohn et al.

[11] 4,366,986

[45] Jan. 4, 1983

[54] CONTROLLED RETORTING METHODS FOR RECOVERING SHALE OIL FROM RUBBLIZED OIL SHALE AND METHODS FOR MAKING PERMEABLE MASSES OF RUBBLIZED OIL SHALE

[75] Inventors: Jack R. Bohn, Rancho Palos Verdes; Durk J. Pearson, Palos Verdes Estates, both of Calif.

[73] Assignee: TRW Inc., Redondo Beach, Calif.

[21] Appl. No.: 139,493

[22] Filed: Apr. 11, 1980

[51] Int. Cl.[3] ..... E21C 41/10

[52] U.S. Cl. ..... 299/2; 166/259; E21B/43/247

[58] Field of Search ..... 299/2; 175/12; 166/261, 166/256, 259, 247; 169/69

[56] References Cited

U.S. PATENT DOCUMENTS

| | | | |
|---|---|---|---|
| 3,331,438 | 7/1967 | Slusser | 166/261 |
| 3,332,488 | 7/1967 | Wilson | 166/259 X |
| 3,406,755 | 10/1968 | Sharp | 166/256 |
| 3,589,773 | 6/1971 | Dixon | 166/247 X |
| 4,015,663 | 4/1977 | Strubhar | 166/259 X |
| 4,093,310 | 6/1978 | Terry | 299/2 |
| 4,200,336 | 4/1980 | Burton | 299/2 |

*Primary Examiner*—Ernest R. Purser

*Attorney, Agent, or Firm*—Benjamin DeWitt; Donald R. Nyhagen; Robert W. Keller

[57] ABSTRACT

In-situ retorting methods include forming an in-situ mass of rubblized, hydrocarbon-containing minerals covering at least part of that mass with a nonflammable liquid such as water, uncovering part of the mass and retorting to produce hydrocarbon values from that part, and then progressively or sequentially uncovering other parts of the mass and retorting hydrocarbons from those parts. Methods for forming highly permeable rubblized masses include forming a retorting zone in a kerogen-bearing formation wherein two walls of the retorting zone form a low angle to one another, and cleaving oil shale from the upper wall beginning near the intersection of the two walls and proceeding upwardly.

13 Claims, 4 Drawing Figures

CONTROLLED RETORTING METHODS FOR RECOVERING SHALE OIL FROM RUBBLIZED OIL SHALE AND METHODS FOR MAKING PERMEABLE MASSES OF RUBBLIZED OIL SHALE

Our invention relates to in-situ retorting of hydrocarbon-containing minerals for the production of carbonaceous values and more particularly to the use of liquid flooding of a rubblized retorting chamber to selectively control the downward progress of the in-situ pyrolysis, thereby overcoming fingering difficulties, reducing the decomposition of valuable hydrocarbons, and increasing the amount of product practicably recoverable from a given quantity of in-situ kerogen-bearing shale.

In its broader aspects our process may employ coventional, known, steps for forming an in-situ pyrolysis chamber filled with rubblized, kerogen-bearing shale and, after the chamber is partially filled with liquid, preferably employs known techniques for inducing pyrolysis such as injection of steam or hot gas or, alternatively, in-situ combustion of a portion of the resource to generate suitable temperatures within the rubble-filled chamber. Our process differs from conventional methods in that the rubble-filled chamber is flooded with water or another nonflammable fluid and the water level therein is regulated as a function of time in a manner such that pyrolysis, occuring in the rubblized material above the water's surface, is controlled to maintain favorable conditions (e.g., temperature) for the pyrolysis of the material. The controlled water level precludes vertically downward fingering and bypassing of combustion around portions of the rubble, provides improved control over the in-situ retorting, and enables recovery of a larger percentage of the hydrocarbons contained in the deposit. Moreover, it enhances the complete pyrolysis of shale exposed above the water level, and successive reductions of the water level may be used to successively pyrolyze a plurality of vertically contiguous, horizontally extending portions or increments of the shale or other carbonaceous mineral deposit.

Our invention finds an immediate and perhaps most useful application in the production of liquid hydrocarbons by in-situ pyrolysis of kerogen-bearing shales such as the so-called oil shale of Colorado's Piecance Creek basin. Many in-situ retorting methods have been proposed for recovering shale oil from oil shale. However, not one of these methods has proved sufficiently economic to form the basis for a commercial operation. In part, the problem has been that in-situ retorting has proved difficult to control.

Our invention provides a method for forming in-situ masses of highly permeable rubblized oil shale and controllably retorting the rubblized shale masses. In one embodiment, our method for forming highly permeable rubblized oil shale masses includes forming a retorting zone in a oil shale-bearing formation with two walls of that zone forming a low angle to one another, and then cleaving oil shale from the upper wall beginning near the intersection of the two walls and proceeding upwardly. Preferably, the low angle between the two walls is in the range of about 5° to about 35° , more preferably in the range of about 10° to about 20°.

In practice, our method for forming highly permeable masses of rubblized oil shale can complement known, proved methods for forming oil shale retorts.

Thus, our retorting zones can be formed from access shafts in oil shale-bearing formations. The retorting zones themselves can be formed in several ways. The zones can be vertical or horizontal, with the horizontal zones tilted or untilted. For example, a spiral array of drifts can be formed next to an access shaft into the formation. Thereafter, the pillars of shale between the drifts are removed to form a downwardly spiraling retorting zone. Alternatively, after forming slot-shaped shafts in an oil shale-bearing formation, and then excavating pluralities of drifts in stope-shaped arrays or staggered along one or more faces of such slots, retorting zones can be formed by removing the pillars of shale between two or more such drifts.

After forming the retorting zone, shale can be cleaved from the upper wall (or ceiling) of the zone. The cleavage preferably begins at or near the intersection of the upper wall with the lower wall (or floor) of the zone and proceeds upwardly therefrom to, or near to the highest point in the zone. The oil shale can be cleaved from the upper wall using a series of explosive charges. During blasting, stress waves reflected from the prefabricated free surfaces cause closely coupled interactions that efficiently dislodge the highly anisotropic oil shale from the upper wall of the retorting zone, particularly where blasting begins from a low point in the zone and moves to a high point. The result is a rubblized oil shale mass of high permeability.

As noted heretofore, a primary feature of our invention is the use of water-flooding for control of in-situ retorting of rubblized masses of oil shale, regardless of how those masses are formed. These methods include forming an in-situ mass of rubblized oil shale, covering at least part of that mass with a nonflammable liquid such as water, exposing at least part of that mass, and then recovering shale oil from that uncovered part by in-situ retorting. After a first exposed zone is thus retorted, we uncover another part of the mass, and retort shale oil from that portion, and continuing this sequential retorting of successively lower horizontal zones until substantially all the shale oil has been recovered from the rubblized mass.

In preferred embodiments, the rubble-filled chamber forms a stope-shaped or inclined porous mass to facilitate controlled retorting and recovery of fluids from the retorting zone.

Moreover, in preferred embodiments, these methods include providing the retorting zones with means for recovering the extracted shale oil from the zone. These means can be one or more conduits placed at or near the bottom of the zone. Such means are also useful for adjusting the level of nonflammable liquid in the retorting zone. In practice, such means can be used to simultaneously lower (or raise) the liquid level in the zone to expose additional oil shale for retorting, and to remove other fluids from the retorting zone.

The extraction of shale oil from the portion of the shale exposed above the liquid level is preferably effected by known retorting methods. For example, in-situ combustion, or retorting of the oil shale with hot gases such as steam or air at temperatures in the range of about 600° F., to about 900° F., liberates liquid and gaseous hydrocarbons from the shale. Thus, retorting can be effected by igniting oil shale in situ, and driving the combustion front forward by injecting air or other oxygen-containing gas into the retorting zone behind the combustion front. Alternatively, retorting can be effected by reverse combustion, in which air or another oxygen-containing gas is injected ahead of the combustion front, and that front moves towards the oxygen feed. Where the rubblized shale mass has an inclined shape, the combustion front can be driven from one side of the mass to the other, beginning at a high point in the mass, and can then be driven back and forth across the face of the mass to a lower level.

In one preferred embodiment of our invention, we first form a rubble-filled chamber by conventional steps of partial mining and blasting. Next, the lower extremes of the rubble-filled chamber are filled with water and retorting is initiated, in a first pyrolysis zone defined between the surface of the water and the ceiling of the rubble-filled chamber. For example, steam or hot gas from a surface source or in-situ combustion is directed through the rubble in a manner to produce a spatial thermal gradient ($\Delta T = 600$ to 900° F.) consistent with favorable conditions for the pyrolysis of kerogen. The lower temperature limit to achieve these conditions will exist above the water surface in the free rubble volume. Through the action of pyrolysis, liberated hydrocarbon liquids will flow under the influence of gravity to the surface of the water and be floated to a water-surface drain which is positioned to maintain a particular water level. Hydrocarbon values may be recovered in a nearby processing plant. When retorting is completed in an upper zone of open porosity, the water level is lowered to expose a fresh porous volume of rubble.

The interval of fresh rubble is now bounded by the depleted rubble above and the water level below. Subsequent retorting action continues as described for the initial interval. As the water level is repetitively lowered it sequentially exposes additional layers, or successive pyrolysis zones, of fresh material. Thus, the retorting proceeds from the first zone to a second adjacent zone and so incrementally downward until the entire rubble pile has been substantially depleted of hydrocarbon values. A primary feature is that each zone is substantially completely retorted before the pyrolysis is allowed to progress to the next, lower zone.

Implementation of the water flood to maintain and control the spatial bounds of the process zone will require special modifications of most conventional retorting systems, and the specifics of the necessary modifications will depend on the nature of the conventional retorting system to which the water-flood process is applied. For example, during the mining operations, a vertical array of ports may be provided in the casings of vertical shafts at the periphery of the rubble chamber to provide access for the withdrawal of gases and liquids. Horizontal conduits connecting these vertical shafts to the retort chamber will serve each port for fluid communication. These conduits may be fitted with valves or sequentially perforated to accomplish the incremental water-level control and withdrawal of process fluids.

When combustion retorting is employed, combustion bypass of portions of the rubble is precluded by the water barrier and combustion can proceed downwardly only after the water level is lowered. The benefits of this feature can be realized utilizing either inclined or vertically oriented retorts. In addition to superior control of combustion and process fluid flow geometry, our process improves hydrocarbon product recovery. That is, in a normal in-situ retort, hydrocarbon products must pass through roughly the length of the rubble bed before collection, and much of the shale oil remains hung up on the rubble where it polymerizes and becomes unrecoverable without further thermal pyrolysis and a consequential loss of product yield. In our process, the hot oil, mist, and hydrocarbon vapors are cooled, condensed, collected, and transported by the water after having traversed only a small fraction of rubble.

The new methods are illustrated in the accompanying drawings, in which.

Figure 1:
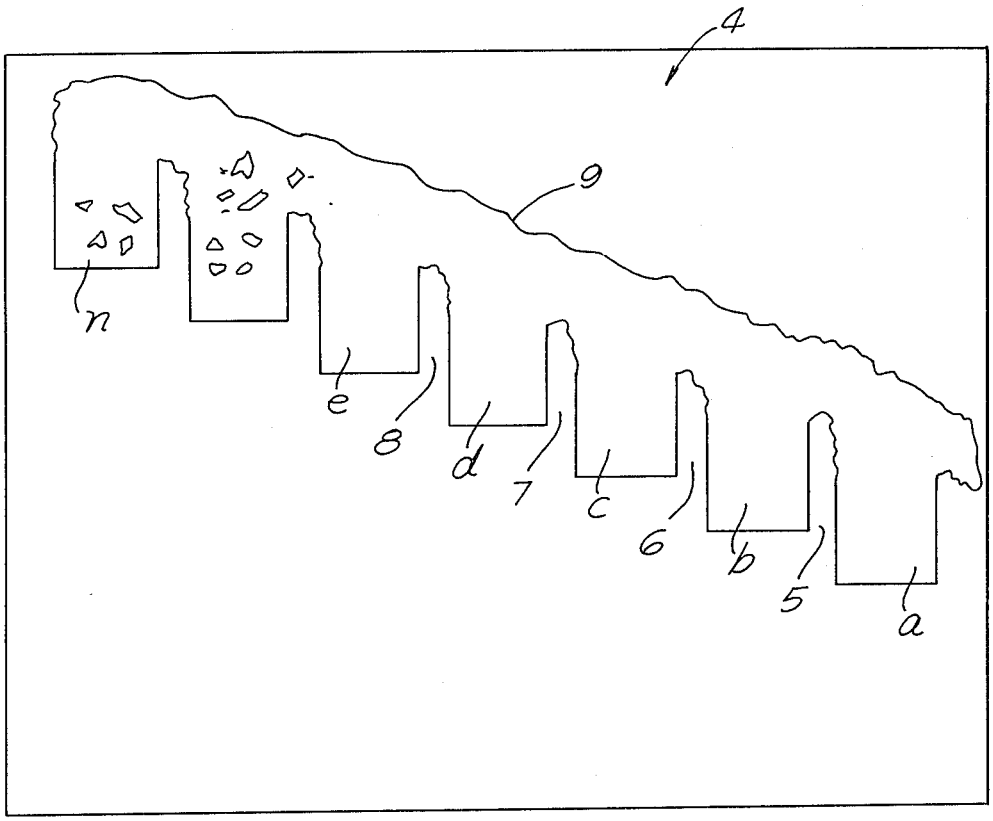
FIG. 1 shows, in schematic form, an example of first steps in preparing a rubblized oil shale mass.

FIG. 1 shows a side wall 4 of a slot-shaped access tunnel formed in a kerogen-bearing formation. From that access tunnel, a plurality of horizontal drifts a, b, c,-----n are formed in the oil shale-bearing formation. These drifts form an inclined array, and have pillars of shale 5, 6, 7 and 8. When the ceilings of these drifts are blasted to fill the drifts with rubble to a new ceiling 9, we form an inclined rubble-filled chamber in which the pillars 5, 6, 7 and 8 provide wall-like elements of low permeability extending part way to the ceiling 9 of the rubblized chamber. As described in detail hereinafter this tends to reduce rapid combustion through low permeability channels and thereby helps to avoid undesirable bypassing of combustion around portions of the rubblized mass. After blasting the rubble-filled chamber has a ceiling 9 which is inclined upwardly, to the left in FIGS. 1 and 2, at an angle within the range from about 10° to about 30° and with a floor substantially coincident with the floors of the several drifts 5, 6, 7 and 8. Of course, the rubble-filled chamber may extend several hundred feet in a direction normal to the plane of FIG. 1.

To cleave the oil shale from the ceilings of the drifts 5, 6, etc. in FIG. 1, explosive charges are in the ceiling of the drifts and are detonated sequentially from the lowest point in the zone to the highest to form a rubblized mass of highly permeable oil shale.

Figure 2:
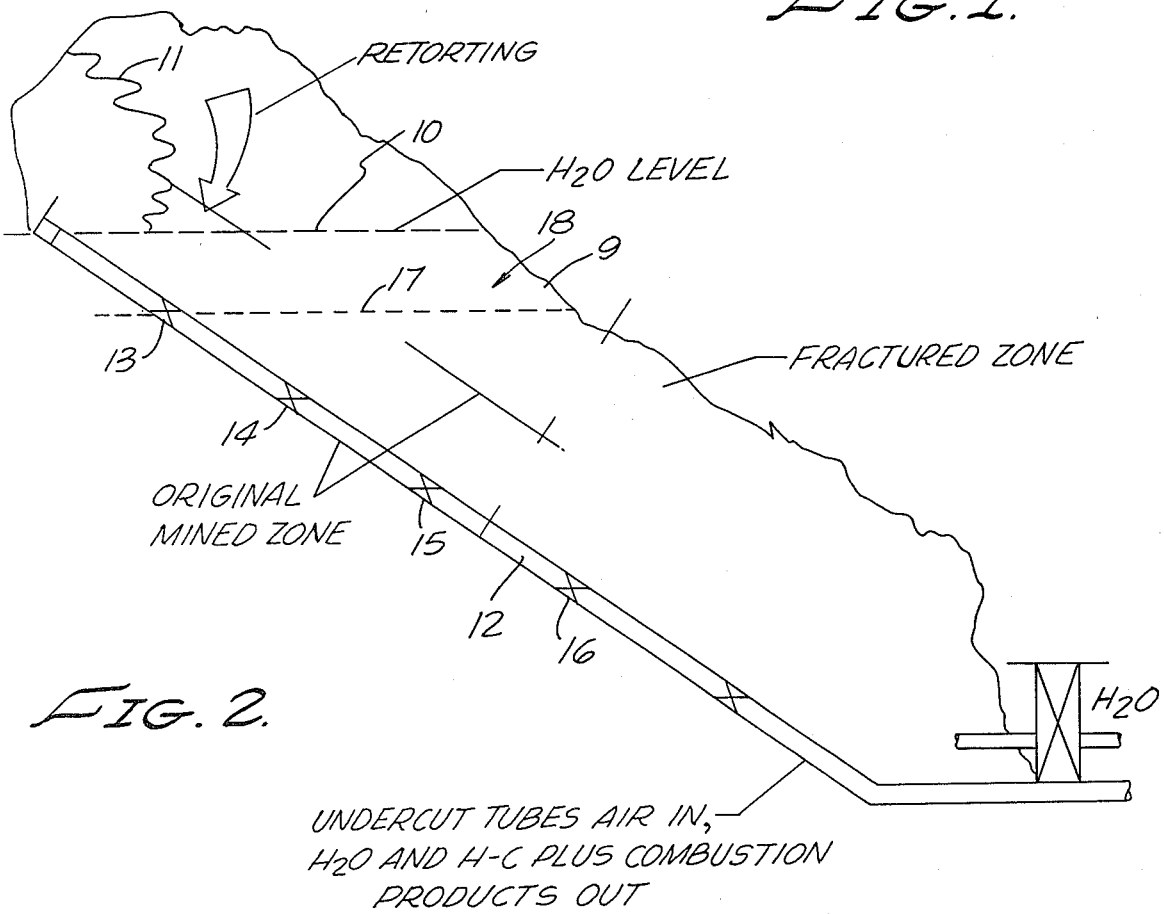
FIG. 2 shows, in schematic form, one embodiment of the new controlled oil shale retorting methods.

As seen in FIG. 2, the rubblized oil shale forms an inclined mass within the retorting zone. Below the rubblized shale mass is conduit 12, which provides means for removing fluids from, and admitting fluids to the retorting zone. FIG. 2 shows the retorting zone filled with water to level 10, with the water covering all but one part of the rubblized shale mass. This condition is obtained by filling the zone with water, and then incrementally lowering the level of the water in the zone to expose horizontal increments of the oil shale for retorting, or by simply filling the zone to water level 10 as shown in FIG. 2. Thereafter, the exposed part of the rubblized oil shale mass is retorted to extract the shale oil therefrom, using any one of various known techniques for this purpose. For example, combustion front 11 can be formed and driven through the exposed rubblized oil shale to retort the shale oil therefrom.

After the exposed part of the rubblized oil shale has been retorted, the liquid hydrocarbon and gaseous products can be recovered through conduit 12, simultaneously lowering the water level in the zone. Thereafter, the newly exposed part of the rubblized mass can be retorted as the first part was, or in another way,as desired. Again, the shale oil and other fluids can be recovered through conduit 12 by sequentially opening valves 13, 14 15 and 16, again lowering the water level to expose another part of the rubblized mass for fuether retorting. For example, when valve 13 is opened water is admitted to conduit 12 until the water level in the rubble-filled chamber drops to the level indicated at 17 in FIG. 2. Thus, there is defined a second retorting zone 18 between water level 17 and the overlying body of depleted shale in the first retorting zone above level 10. Alternatively, instead of retorting and lowering the water level in alternate steps, these two steps can be done continuously by lowering the water level gradually as retorting proceeds.

Figure 3:
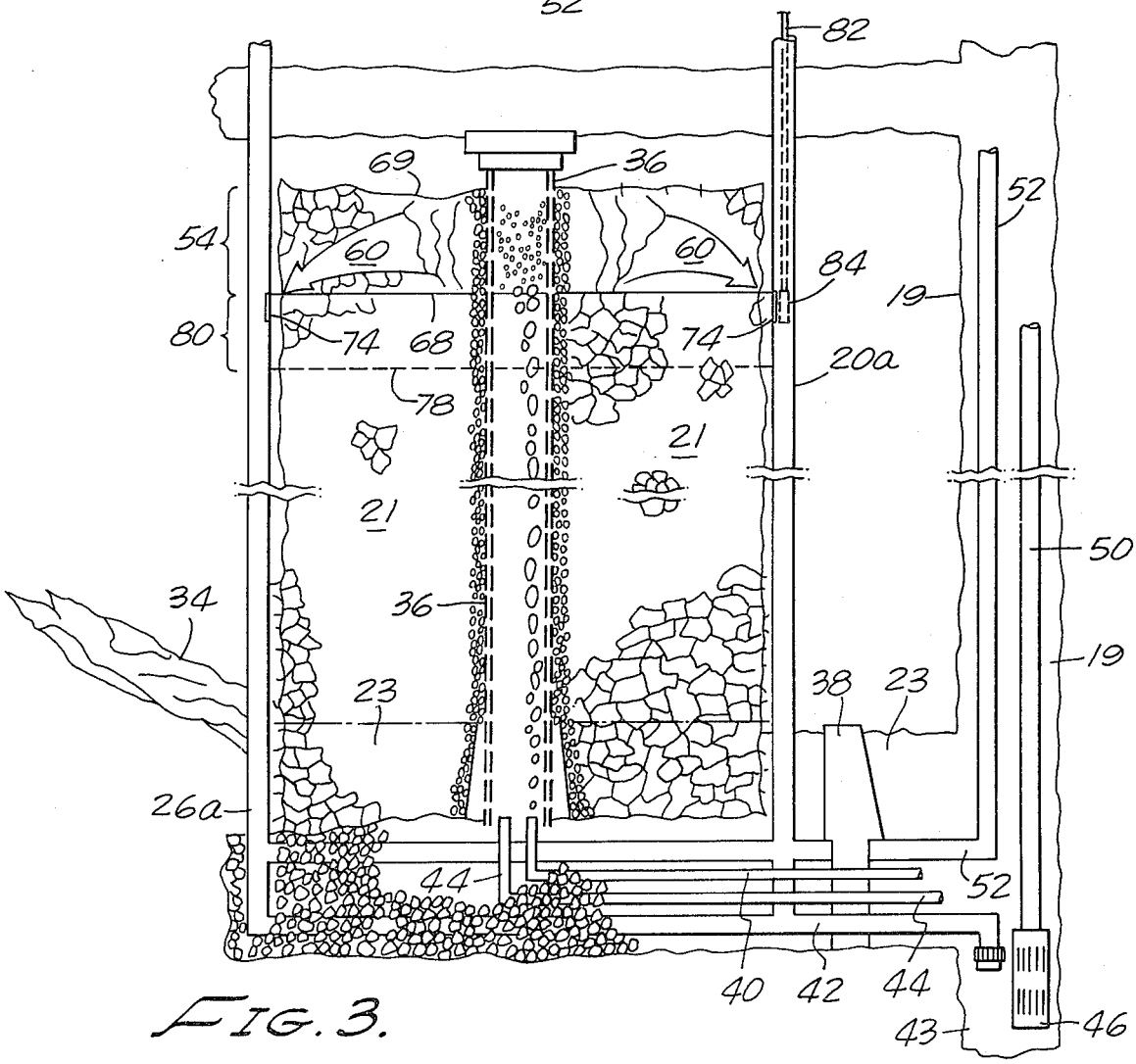

As noted above, the specific modifications of a conventional rubblized chamber retorting system that are necessary for applying our invention will depend on the characteristics and configuration of the particular system. FIG. 3 illustrates, diagramatically, a currently preferred implementation of our invention as it is applied to a vertical-axis shale retort of the type disclosed, for example, in U.S. Pat. No. 3,980,339 issued Sept. 14, 1976. FIG. 3 is a vertical cross-sectional view of an earth formation comprising a deposit of suitable carbonaceous mineral such as the kerogen-bearing shale deposits of Colorado. After a suitable location is selected a shaft 19 is sunk through the overburden and a major portion of the deposit, to or near the base of the deposit, and a horizontal tunnel 23 is formed from the base of the shaft to and under the area of the deposit from which carbonaceous values are to be removed by in-situ processing. This area is undermined to remove from 10% to 30% of the kerogen-bearing shale. Several conduits are installed in the tunnel 23, as described in more detail hereinafter, and the shale overlying the undermined area is broken by suitable blasting techniques to form a rubble-filled chamber 21 in which the body of broken shale has a porosity and permeability very substantially exceeding that of the original shale deposit. Thus there is formed within the deposit a substantially rectangular rubble-filled chamber 21 which may be, for example, about 100 feet square and about 200 feet high.

Either before or after the rubblizing step four wells 20, 22, 24, and 26 are drilled at the corners of the rubblized chamber and are provided with conventional oil well casings 20*a*, 22*a*, 24*a* and 26*a*, preferably about 10 inch or 12 inches in diameter. At the center of the rubble-filled chamber a large diameter shaft is formed and is provided with a perforated conduit 36 extending from the base of the rubblized chamber at least to the ceiling 69 of the chamber. This conduit 36 preferably is about 2 or 3 feet in diameter, and is perforated along its entire length so that the open area is at least about 40% to 60% of the conduit surface; it may be formed of heavy sheet metal such as that used in highway culverts or alternatively may comprise extra heavy duty wire screen. The conduit 36 may be filled with a high porosity, high-permeability material or if desired may be left empty so that it provides a void extending vertically at the center of the rubblized chamber. Preferably conduit 36 is positioned at the center of the region which is to be rubblized before the shale surrounding it is rubblized, by blasting.

Adjacent one side of the rubblized chamber 21 the access tunnel 23 is permanently blocked by forming a concrete barrier 38 through which are extended a plurality of fluid conduits 40, 42 and 44. Conduit 40 extends to the base of perforated conduit 36 and is used to continuously feed air for combustion upwardly through conduit 36. Air is supplied to conduit 40 by way of primary shaft 19 from an air-feed subsystem which may comprise a blower (not shown) or other suitable equipment located at the surface. Conduit 42 is connected to the bottom end of the casings 20*a*, 22*a*, 24*a* and 26*a* for collecting liquid product from these casings and conveying it to a sump 43 from which liquid product may be removed to the surface by means of a suitable pump 46. Conduit 44 extends from a conventional water supply pipe located in the primary shaft 19 through the concrete barrier 38 and preferably extends to the base of conduit 36 for providing water to flood the rubblized chamber and to maintain the water level therein at a desired level even in the presence of substantial evaporation. While conduit 44 preferably extends into the bottom end of conduit 36, it may, if desired, be terminated at substantially any place within the rubblized chamber so long as it serves to continuously feed water for flooding the chamber.

In some locations the rubblized chamber may encounter water bearing strata such as the natural aquifier 34 shown in FIG. 3. In such cases, water flow from the natural aquifier may be used to flood the rubblized chamber, at least in part, and operation of our invention, as described in more detail hereinafter, requires only that the water supply conduit 44 feed enough water to supplement the natural flow from aquifier 34 and maintain the water level in the chamber at a desired level 68. It will be apparent that if the natural flow from aquifier 34 exceeds the operating requirements, flow through conduit 44 may be reversed by suitable pumping arrangements to continuously withdraw some water from the rubblized chamber and thereby maintain the water level in the chamber at a desired level. The primary shaft 19 will, of course, include appropriate conduits extending to the surface to implement the several functions described above. Additionally, shaft 19 includes a gas conduit 52 that extends through the barrier 38 and connects to the casing in each of the wells 20, 22, 24 and 26 to withdraw gaseous products of combustion. Preferably conduit 52 connects to each casing at a level slightly above the conduit 42 which extends from the base of each casing to the sump 43 so that gaseous products of retorting are thereby separated from the liquid products and separately withdrawn to the surface through conduits 50 and 52.

Figure 4:
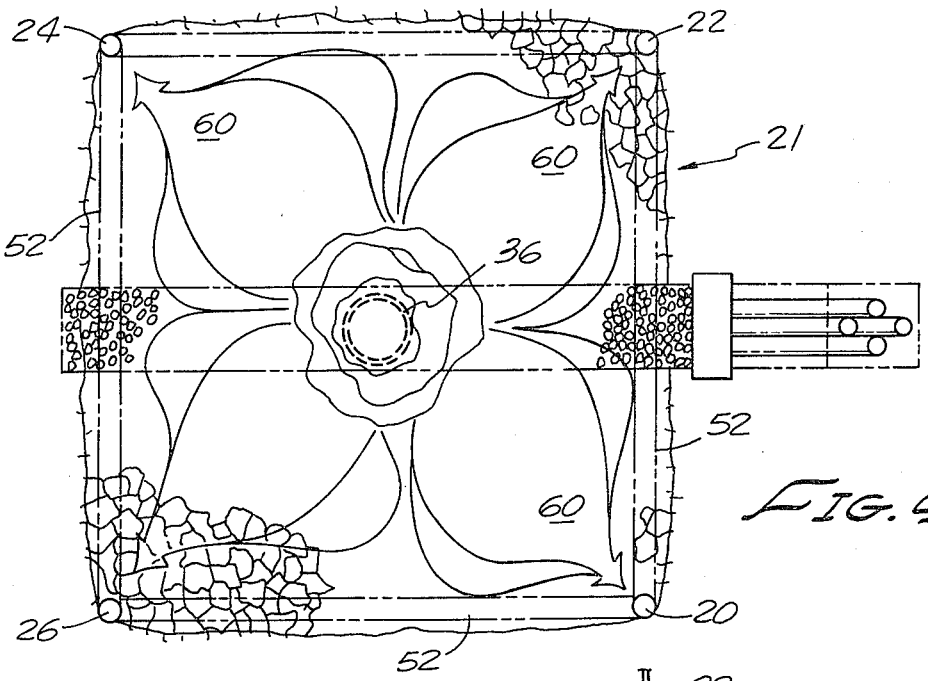
FIGS. 3 and 4 illustrated, in elevation and plan views respectively, a further embodiment of our invention as it is applied to retorting in a vertical-axis rubble-filled chamber.

The rubble-filled chamber 21 is filled with water to a level 68 at least several feet below the ceiling 69 of the chamber. Air flow is initiated through conduit 40 and exits at the upper portion of conduit 36 into the rubble-filled first pyrolysis zone defined between the water surface 68 and the chamber's ceiling 69. After air flow is established, combustion is initiated in the first pyrolysis zone 54 immediately adjacent the periphery of conduit 36. Simultaneously, air and gaseous products of combustion are withdrawn from the chamber by gas flow, as indicated at 60, through the rubblized shale and to perforations 74 in the casings 20*a*, 22*a*, 24*a* and 26*a*. These exhaust gases are drawn downwardly through the vertical casings and out to the primary shaft through conduit 52. Thus, as best shown in FIG. 4, within the first pyrolysis zone 54 retorting occurs horizontally from the center conduit 36 toward the four corners and, also, retorting proceeds vertically from the top of the rubble pile until substantially all the rubber above water level 68 has been retorted to remove volatile constituents and to convert the kerogen to carbonaceous liquids which are floated on the water's surface outwardly to wells 20, 22, 24 and 26 and drained downwardly, through their respective casings, to be removed to the surface by way of conduit 42 sump 43 and pump 46.

When pyrolysis of the material in the first pyrolysis zone 54 is substantially complete, the water level in the chamber 21 is lowered to a second water level 78 to define a second pyrolysis zone 80 between the water level 78 and the previously depleted char remaining in the first pyrolysis zone. At this time the char in the first pyrolysis zone is burning and provides a source of radiant heat for igniting and/or retorting the material in the second pyrolysis zone so that pyrolysis continues from the first zone to the second zone without interruption. In a similar manner the water level may be successively lowered at appropriate times through a plurality of retorting increments, or sequential pyrolysis zones, until substantially all of the carbonaceous values contained in the rubble within chamber 21 are removed and the water level approaches the base of the chamber. Control of the water level in the chamber from level 68 to level 78 etc. may be provided by any one of several techniques well known in the art. For purposes of illustration there is shown in FIG. 3 a tool string 82 extending downwardly in the casing of well 20 and provided at its lower end with a perforating tool 84 for explosively opening the side wall of the casing to allow liquid hydrocarbons to flow from the water surface 68 downwardly through the casing of well 20 and also to allow gaseous products of combustion to be withdrawn through the rubble and the perforations. For example, when retorting of the rubble in first zone 54 is substantially complete, the perforating tool 84 is inserted downwardly to the desired elevation of the water level for the second pyrolysis zone and the casings of wells 20, 22, 24 and 26 are perforated at this lower level 78 to permit the flow of gases and retorting-product fluids downwardly through the casings.

We claim:

1. In a process for the in-situ recovery of carbonaceous values from a subterranean kerogen-bearing shale deposit, the steps of:

undermining a portion of said deposit and breaking an overlying portion thereof to provide a chamber filled with rubblized particulate shale having a porosity substantially exceeding that of the original deposit;

flooding said rubblized shale with water in a manner to define a first pyrolysis zone of limited height between the water surface and the ceiling of said chamber;

pyrolyzing the shale within said first zone;

lowering the water level in said chamber to define a second pyrolysis zone of limited height between the surface of said water and the previously pyrolyzed material in said first zone;

pyrolizing the shale within said second zone; and recovering from said zones liquid and gaseous carbonaceous products of pyrolysis.

2. A method comprising forming an in-situ mass of rubblized oil shale, covering at least part of said mass with a nonflammable liquid, pyrolitically extracting hydrocarbon values from the exposed part of said mass, controlling pyrolysis of said exposed part by regulating the level of said nonflammable liquid, and recovering extracted, liquified hydrocarbon values from the surface of said nonflammable liquid at a rate sufficient to substantially preclude combustion of said extracted liquified hydrocarbons.

3. A method comprising forming an in-situ mass of rubblized oil shale, covering at least part of said mass with a nonflammable liquid, uncovering at least part of said mass and pyrolitically extracting shale oil from said uncovered part, uncovering another part of said mass, pyrolitically extracting shale oil from said other part of said mass, and effecting substantially complete pyrolysis of each exposed part by regulating the level of said nonflammable liquid.

4. A method comprising forming an in-situ mass of rubblized hydrocarbon values-containing minerals, covering at least part of said mass with a nonflammable liquid, uncovering at least part of said mass and retorting hydrocarbon values from said uncovered part, controlling said retorting by regulating the level of said nonflammable liquid and recovering said hydrocarbon values from the surface of said nonflammable liquid at a rate sufficient to substantially preclude loss of the recovered hydrocarbon values through combustion or otherwise.

5. A method comprising forming an in-situ mass of rubblized oil shale, covering at least part of said mass with a nonflammable liquid, uncovering at least part of said mass and retorting shale oil from said uncovered part, recovering the retorted shale oil in liquified form from the surface of said nonflammable liquid at a rate sufficient to substantially preclude loss through combustion or otherwise, uncovering another part of said mass, retorting shale oil from said other part of said mass, and controlling the retorting of each uncovered part by regulating the level of said nonflammable liquid.

6. The method of claims 2 or 3 further comprising providing said in-situ mass with means for recovering shale oil from said mass, and recovering shale oil through said means.

7. The methods of claims 2, 3, 4, or 5 wherein the nonflammable liquid is water.

8. The method of claims 2, 3, 4 or 5 further comprising providing said in-situ mass with means for recovering shale oil from said mass and means for adjusting the level of said nonflammable liquid covering said mass.

9. The method of claim 8 wherein said mass is inclined.

10. The method of claims 2, 3, 4 or 5 wherein said mass forms an incline, and said mass is retorted downwardly.

11. In a process for the in-situ recovery of carbonaceous values from a subterranean deposit, the steps of:

providing, within said deposit, a chamber filled with fractured material having a porosity exceeding that of the original deposit and containing carbonaceous minerals;

flooding said material with a non-flammable fluid to provide a first retorting zone above the fluid's surface;

retorting the fractured material in said first zone to remove liquid and/or gaseous carbonaceous values therefrom;

lowering the fluid level in said chamber to provide a second retorting zone above the fluid's surface; and retorting the material in said second zone in a manner to remove liquid and/or gaseous carbonaceous values therefrom.

12. In a process for the recovery of carbonaceous values from a subterranean deposit, the steps of:

providing within said deposit, a chamber filled with rubblized particulate material having a porosity exceeding that of the original deposit;

flooding said material with a fluid to provide a first pyrolysis zone above the surface of said fluid;

at least partially pyrolizing the particulate material within said first zone to recover carbonaceous values therefrom;

lowering the fluid level in said chamber to expose particulate material within a second pyrolysis zone between said first zone and said fluid so that pyrolysis proceeds from said first zone to said second zone, and recovering carbonaceous values from said zones.

13. A method comprising forming an in-situ mass of rubblized oil shale, covering a substantial part of said mass with a nonflammable liquid, initiating combustion in the uncovered part of said mass, and pyrolyzing substantially all of the shale oil from said uncovered part, uncovering an additional part of said mass and retorting shale oil from said uncovered part utilizing the char in the first part as a fuel source for pyrolysis, controlling said retorting by regulating the level of said nonflammable liquid, and recovering shale oil from the surface of said nonflammable liquid at a rate sufficient to substantially preclude loss of the retorted shale oil through combustion or otherwise.

* * * * *